US009957096B2

(12) United States Patent
Niec

(10) Patent No.: US 9,957,096 B2
(45) Date of Patent: May 1, 2018

(54) PRESSURIZED CAN

(75) Inventor: Philippe Gérard Stanislas Niec, Sablé-sur-Sarthe (FR)

(73) Assignee: Ardagh MP Group Netherlands B.V., Deventer (NL)

( * ) Notice: Subject to any disclaimer, the term of this patent is extended or adjusted under 35 U.S.C. 154(b) by 1465 days.

(21) Appl. No.: 12/516,910

(22) PCT Filed: Nov. 29, 2007

(86) PCT No.: PCT/EP2007/010731

§ 371 (c)(1),
(2), (4) Date: Dec. 29, 2009

(87) PCT Pub. No.: WO2008/064920

PCT Pub. Date: Jun. 5, 2008

(65) Prior Publication Data

US 2010/0127001 A1 May 27, 2010

(30) Foreign Application Priority Data

Nov. 29, 2006 (EP) ..... 06024708

(51) Int. Cl.
*B65D 79/00* (2006.01)
*B65D 83/38* (2006.01)

(52) U.S. Cl.
CPC ..... *B65D 79/005* (2013.01); *B65D 83/38* (2013.01)

(58) Field of Classification Search
USPC ..... 220/604, 608, 609, 606
See application file for complete search history.

(56) References Cited

U.S. PATENT DOCUMENTS

| | | | | |
|---|---|---|---|---|
| 4,151,927 | A * | 5/1979 | Cvacho et al. | 220/606 |
| 4,177,746 | A * | 12/1979 | Lee et al. | 413/8 |
| 5,279,442 | A * | 1/1994 | Jentzsch et al. | 220/671 |
| 5,388,716 | A * | 2/1995 | Stoffel et al. | 222/3 |
| 6,220,073 | B1 * | 4/2001 | Cheng et al. | 72/348 |
| 2004/0000533 | A1 * | 1/2004 | Kamineni et al. | 215/373 |
| 2004/0035871 | A1 * | 2/2004 | Chupak | 220/608 |
| 2005/0247717 | A1 * | 11/2005 | Brifcani et al. | 220/619 |
| 2006/0071005 | A1 * | 4/2006 | Bulso | 220/619 |
| 2010/0127001 | A1 * | 5/2010 | Niec | 220/609 |

FOREIGN PATENT DOCUMENTS

GB 1572031 7/1980

* cited by examiner

*Primary Examiner* — James N Smalley
*Assistant Examiner* — Madison L Poos
(74) *Attorney, Agent, or Firm* — The Webb Law Firm

(57) ABSTRACT

The invention relates to a pressurized can, such as an aerosol can, having a bottom comprising a panel connected via a countersink and a foot to the can body wall, which bottom has a panel with a substantially non-concave form.

14 Claims, 3 Drawing Sheets

PRESSURIZED CAN

BACKGROUND OF THE INVENTION

Field of the Invention

The present invention relates to a pressurized can, such as an aerosol can.

Description of the Related Art

A pressurized can is generally made of one piece and comprises a bottom, a can body wall and an open end for filling and emptying. Pressure is used for emptying the content, such as liquid, gas, foam, paste and the like. The pressurized can has a bottom which comprises a central panel connected via a countersink and a foot to the can body wall.

Known pressurized cans, such as aerosol cans are characterized by the presence of a central panel which has a concave shape.

SUMMARY OF THE INVENTION

It is an object of the present invention to provide a pressurized can which is provided with a bottom that can withstand internal pressure and still has a bottom wall thickness which is thinner than conventional pressurized cans, while still providing volume expansion.

Generally pressurized cans have a diameter in the range of about 20-80 mm, preferably within the range of 30-70 mm. Exemplified are diameters of 30 mm, 45 mm and 60 mm.

It is an object of the present invention to provide a pressurized can which is designed for high pressure resistance (such as up to 15 bar, preferably up to 18 bar) and still has a minimum thickness in the range of for instance 0.2-0.7 mm, generally within the range of 0.3-0.6 mm dependent on the diameter of the can. Such a pressurized can is in particular suitable for use as an aerosol can. The can according to the invention should have a pressure behaviour which combines the ability to withstand pressures without permanent deformation, and elastic deformability to a given volume. Up to a particular pressure the bottom may deflect to a certain extent and ultimately will form buckles. In relation to the elastic deformability it is according to the invention that up to about 15 bars deformations should not be visible. However, the pressurized can should be deformable up to a given volume under pressure. Accordingly, it is possible to have an indication of the presence of pressure (and the absence of pressure leak).

Accordingly, it is possible with a can according to the invention that the significant elastic deformation against pressure allows inspection of the cans during different stages of handling, such as closure processing and storage. Such outward inspection may be carried out with classical detector systems measuring particular distances to a sensor, such as a proximity sensor, laser sensor, induction sensor and ultrasonic sensor. This provides the opportunity to inspect the cans for too low or too high internal pressures. For instance at closure for monitoring the pressurization process and/or after processing the cans for detection of pressure loss due to leakage or pressurizing due to chemical reactions.

A can according to the invention should have an optimal axial load resistance. Such axial load resistance provide a narrow footing with an increase of the vertical load. Accordingly, there is less deformability against axial load.

The afore mentioned objectives, needs and advantages are obtained with a pressurized can according to the invention having a bottom comprising a panel connected via a countersink and a foot to the can body wall, which bottom has a panel with a substantially non-concave form.

More specific the pressurized can, such as an aerosol can having a substantially non-concave bottom panel is characterized in that:

the foot wall angle A1 is in the range of about −10 to 45°;
the panel wall angle A2 is in the range of about 0-45°;
the foot radius R2 is less than about 5 mm;
the countersink radius R3 is less than about 5 mm;
the panel radius R4 is larger than about 0.5 mm;
the unit depth H1 is in the range of about 2-20 mm; and
the panel depth H2 is in the range of about 1-15 mm.

The foot wall angle A1 is selected such in order to provide a vertical structural element required for the pressure resistance. As from −10° sufficient pressure resistance is obtained. Whereas above 45° resistance to pressure decreases such that it requires a larger bottom wall thickness. A foot wall angle A1 of 0° is ideal for providing a maximum strength. However, additional tooling steps are required in order to reach this vertical position or positions closed to the vertical position. For best economy in relation to material consumption and for one step forming it is preferred that the foot wall angle A1 is within the range of 2-35°.

The panel wall angle A2 is in the range of about 0-45°. Preferably the panel wall angle A2 is within the range of 2-35° for similar arguments as given in relation to the foot wall angle A1.

The foot radius R2 is less than about 5 mm although a minimum R2 is always required. A smaller foot radius R2 is beneficial to the strength. Preferably the foot radius R2 is within the range of about 0.5-1.5 mm. At a lower radius tooling is minimum.

The countersink radius R3 is less than about 5 mm although a small countersink radius R3 is always required. A lower countersink radius is good for strength. Preferably the countersink radius is within the range of about 0.5-1.5 mm for similar reasons as given above for the foot radius R3.

The panel radius R4 is larger than about 0.5 mm. This provides a smooth connection between the central bottom panel and the countersink which is large enough for formation by proper tooling. Preferably the panel radius R4 is in the range of 1.0-1.5 mm which is optimal for production and pressure performance.

The unit depth H1 and panel depth H2 are generally within the range of 1.5 mm and preferably within the range of 2-10 mm providing a optimal form for the countersink.

According to a preferred embodiment the panel outer ring slope A3 is within the range of 0-35°. At a slope of 0° the central panel is substantially flat. At a larger outer ring slope A3 there is a smooth connection towards the countersink. At low outer ring slope A3 there is a postponement of pleat appearance. Within the preferred range of 2-20° the panel outer ring slope A3 provides normal curves.

According to another preferred embodiment the panel outer ring width L1 is within the range of about 0-15 mm and preferably within the range of 1-5 mm thereby providing normal or optimal protection against the forming of wringles.

According to a preferred embodiment the central panel radius R5 is larger than about 20 mm. The larger the central panel radius the more flat the central portion will become in a transition from convex to substantially flat. The central panel radius R5 is preferably within the range of 30-100 mm in order to resist pressure and avoid to go beyond the elastic limits.

According to another preferred embodiment the foot outer radius R13 is less than about 5 mm and preferably within the range of 0.5-1.5 mm thereby providing a good or optimal connection with the body wall.

According to another preferred embodiment the foot height H11 is within the range of about 1-7 mm, preferably within the range of 2.5 mm thereby providing an optimal or a further improved strength.

The pressurized can according to the invention has a diameter which is within the range of generally 20-80 mm preferably within the practical ranges of 30-70 mm. The bottom thickness may be within the range of 0.2-0.7 mm and still withstanding internal pressures of up to 15 bar preferably up to 18 bar. More preferably the thickness of the bottom of the pressurized can is within the range of 0.3-0.6 mm dependent on the diameter.

The pressurized can according to the invention is generally made of metal. Preferably the metal used is steal or aluminum. In the case of aluminum it is preferred to use aluminum from the 3000 series, such as aluminum 3104.

Mentioned and other features and characteristics of the pressurized can, such as an aerosol can according to the invention will be further discussed with reference to the annexed drawings which are given for information purposes and not intended to limit the invention to any extent.

DETAILED DESCRIPTION OF THE PREFERRED EMBODIMENTS

Figure 1:
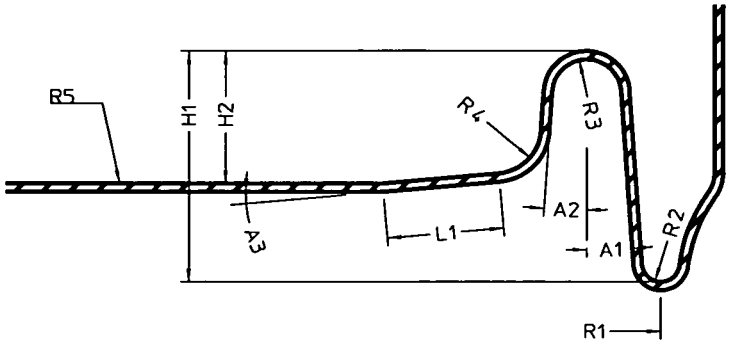
FIG. 1 is a cross section of a part of the bottom of a pressurized can according to the invention.
Figure 2:
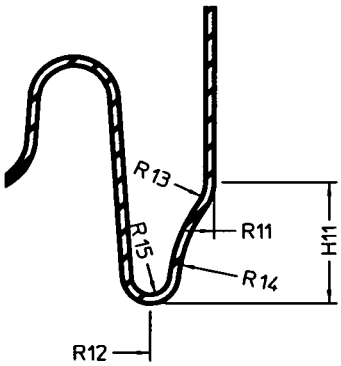
FIG. 2 is a detail from FIG. 1 in relation to the foot of the pressurized can according to the invention.

FIG. 1 shows a part of the bottom of a pressurized can according to the invention. The pressurized can has a cylindrical form of which the body can wall is substantially vertical and connected to a preferably necked opening for filling and emptying the content for the pressurized can.

In the given example the bottom has the following dimensions:

A1 food wall angle 1°
A2 panel wall angle 1°
A3 panel outer ring slope 0°
L1 panel outer ring width 0 mm
R2 foot radius 1 mm
R3 countersink radius 1 mm
R4 panel radius 1 mm
R5 center panel radius 40 mm.

The bottom has a thickness of 0.4 mm and was made of aluminum 3140.

The can had a foot radius R1 of 17.5 mm. The diameter of the pressurized can according to the invention was 45 mm.

At a unit depth H1 of 10.0 to 10.4 mm and at a panel depth H2 of 4.0 to 4.4 mm the pressurized can could withstand a pressure up to about 19 bars prior to the formation of buckles.

Figure 3:
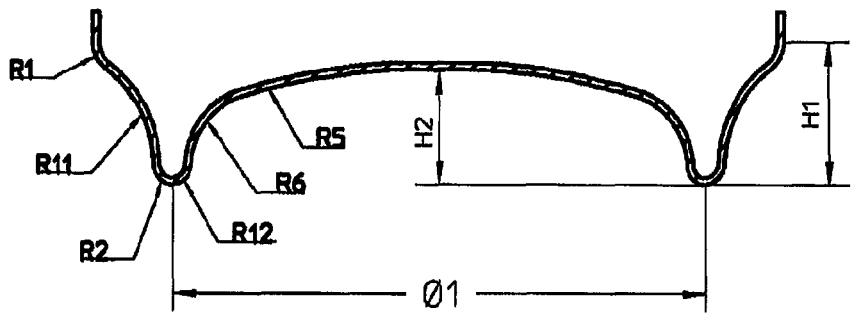
FIGS. 3-5 are other profiles of bottoms for a pressurized can.
Figure 4:
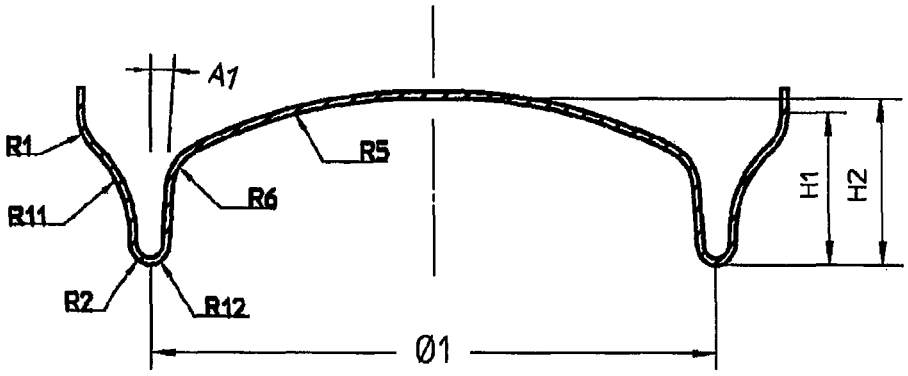
Figure 5:
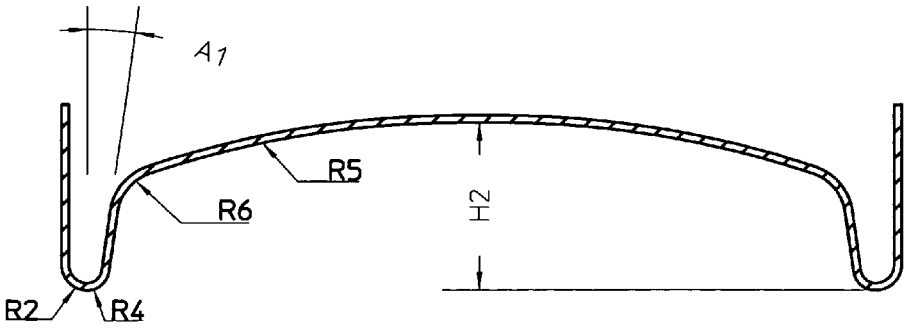

The FIGS. 3, 4 and 5 show other profiles for a bottom of a pressurized can.

For aerosol cans having a diameter of 30 mm, 45 mm and 60 mm the main parameters for the bottom shown in FIG. 3 are as follows:

| Main parameters | | | |
|---|---|---|---|
| Parameter | Range | Preferred range | Importance |
| Ø1 | 20-45 | 35-40 | High |
| H2 | 3-25 | 5-15 | High |
| R2 | 0.5-3 | 0.7-2 | High |
| R4 | 0.5-3 | 0.7-2 | High |
| R5 | 15-100 | 25-50 | Minor |
| R6 | 0.5-10 | 0.7-5 | Minor |
| H1 | 2-20 | 4-10 | Minor |

In relation to the bottom profiles shown in FIG. 4 the following main parameters are relevant:

| Main parameters | | | |
|---|---|---|---|
| Parameter | Range | Preferred range | Importance |
| Ø1 | 20-45 | 35-40 | High |
| H2 | 3-25 | 5-15 | High |
| R2 | 0.5-3 | 0.7-2 | High |
| R4 | 0.5-3 | 0.7-2 | High |
| A1 | 0-30° | 0-15° | High |
| R5 | 15-100 | 25-50 | Minor |
| R6 | 0.5-10 | 0.7-5 | Minor |
| H1 | 2-20 | 4-10 | Minor |

Finally, the main parameters of the bottom profile shown in FIG. 5 are as follows:

| Main parameters | | | |
|---|---|---|---|
| Parameter | Range | Preferred range | Importance |
| H2 | 3-25 | 5-15 | High |
| R2 | 0.5-3 | 0.7-2 | High |
| R4 | 0.5-3 | 0.7-2 | High |
| A1 | 0-30° | 0-15° | High |
| R5 | 15-100 | 25-50 | Minor |
| R6 | 0.5-10 | 0.7-5 | Minor |

The invention claimed is:

1. A pressurized metal can having a bottom comprising a panel connected with a panel radius (R4) to a countersink having a panel wall angle (A2), a foot wall angle (A1), and a countersink radius (R3), which countersink is connected to a foot having a foot radius (R2) and the foot is connected to a can body wall, which panel has a substantially non-concave form, wherein the foot wall angle (A1) is in the range of about 0 to 45°;
a panel wall angle (A2) is in the range of about 0-45°;
the foot radius (R2) is in the range of about 0.5 to 1.5 mm;
the countersink radius (R3) is in the range of about 0.5 to 1.5 mm;
the panel radius (R4) is in the range of about 1 to 1.5 mm;
a unit depth (H1) is in the range of about 5-15 mm;
a panel depth (H2) is in the range of about 2-10 mm; and
a center panel radius (R5) is larger than about 20 mm,
wherein the can has a diameter in the range of about 20-80 mm, a bottom thickness in the range of 0.2-0.7 mm, and a pressure resistance up to about 15 bar.

2. The pressurized metal can according to claim 1, wherein the pressurized can is an aerosol can.

3. The pressurized metal can according to claim 1, wherein a panel wall angle (A2) is in the range of about 2-35°.

4. The pressurized metal can according to claim 1, wherein a panel outer ring slope (A3) is in the range of about 0-35°.

5. The pressurized metal can according to claim 1, wherein a panel outer ring width (L1) is within the range of about 0-15 mm.

6. The pressurized metal can according to claim 1, wherein a foot outer radius (R13) is less than about 5 mm.

7. The pressurized metal can according to claim 1, wherein a foot height (H11) is in the range of about 1-7 mm.

8. The pressurized metal can according to claim 1 made of at least one of the following: steel, aluminum, 3000 series aluminum, or any combination thereof.

9. The pressurized metal can according to claim 1, wherein a panel outer ring slope (A3) is in the range of about 2-20°.

10. The pressurized metal can according to claim 1, wherein a panel outer ring width (L1) is within the range of about 1-5 mm.

11. The pressurized metal can according to claim 1, wherein a foot outer radius (R13) is less than about 0.5-1.5 mm.

12. The pressurized metal can according to claim 1, wherein a foot height (H11) is in the range of about 2-5 mm.

13. The pressurized metal can according to claim 1, having a diameter in the range of 30-70 mm.

14. The pressurized metal can according to claim 1, having a pressure resistance of up to about 18 bar.

* * * * *